United States Patent [19]

Chalmers et al.

[11] 4,135,110

[45] Jan. 16, 1979

[54] ELECTRICAL DISCHARGE LAMP

[75] Inventors: Alan G. Chalmers; Frank L. Whittaker; David O. Wharmby, all of London, England

[73] Assignee: Thorn Electrical Industries Limited, London, England

[21] Appl. No.: 831,551

[22] Filed: Sep. 8, 1977

Related U.S. Application Data

[63] Continuation-in-part of Ser. No. 656,268, Feb. 9, 1976, abandoned.

[30] Foreign Application Priority Data

Feb. 13, 1975 [GB] United Kingdom ..... 6181/75

[51] Int. Cl.[2] ..... H01J 61/20; H01J 61/22

[52] U.S. Cl. ..... 313/225; 313/229

[58] Field of Search ..... 313/229, 225

[56] References Cited

U.S. PATENT DOCUMENTS

| | | | |
|---|---|---|---|
| 3,781,586 | 12/1973 | Johnson | 313/229 X |
| 3,867,664 | 2/1975 | Chalmers et al. | 313/229 |
| 3,882,345 | 5/1975 | Kazek et al. | 313/229 |
| 3,958,145 | 5/1976 | Jack et al. | 313/229 X |

*Primary Examiner*—Palmer C. Demeo

*Attorney, Agent, or Firm*—Robert F. O'Connell

[57] ABSTRACT

Electrical discharge lamps containing mixed halides of superior performance are provided by the inclusion in the lamp of a volatile complex halide compound of tin and sodium. The halide may be added as a mixture of tin and sodium halide but the complex is formed in operation of the lamp and has a much higher volatility than the constituent halides. The preferred lamps contain 5 to 100 micromoles tin and 1 to 250 micromoles sodium halide per cubic centimeter, in a gas fill containing more than 50 micromoles per c.c. mercury.

9 Claims, 2 Drawing Figures

ELECTRICAL DISCHARGE LAMP

Figure 1:
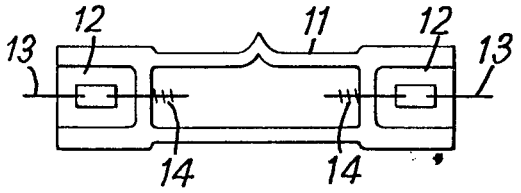

The present application is a continuation-in-part of our application Ser. No. 656,268, filed Feb. 9, 1976, and now abandoned.

This invention relates to electrical discharge lamps and more especially to high-pressure discharge lamps for general lighting purposes. Such discharges operate in an atmosphere of mercury vapour and a small pressure of rare gas together with the vaporised halide of at least one other element. The rare gas is only required to promote easy starting of the discharge.

High pressure discharges in tin halide vapours have continuous spectra, with few atomic lines. These discharges usually have excellent colour rendering properties, and in the cases of the chloride and bromide high efficacy, but their chromaticity coordinates are usually on the green side of the full radiator locus. Discharges in mixed halides of tin have been used to produce a more appealing colour appearance without a significant loss of efficacy. The colour appearance is partly determined by the relative quantities of chlorine and iodine present in the vapour. Chemical reactions during the operation of the lamp tend to change the vapour composition, making it difficult to keep the colour constant.

For many interior lighting purposes, it is desirable to have a different colour appearance from that obtainable with tin halide discharges, and more particularly a lower correlated colour temperature and chromaticity coordinates close to the full radiator locus.

U.S. Pat. No. 3,882,345 to Kazek et al. filed Nov. 12, 1973 and issued May 6, 1975 discloses a tin halide lamp containing stannous chloride, stannous oxide and mercury, and excess of tin and inert starting gas and a predetermined small quantity of sodium chloride, bromide or iodide, which impose sodium lines on the pre-existing substantially continuous emission spectrum. The lamps disclosed in this patent have a relatively low mercury density (from 2.0 to 6.0 mg.cm$^{-3}$, which corresponds to 10 to 30 $\mu$mols cm$^{-3}$) and although "high efficacy" is referred to, the intention of the patentees is essentially directed towards spectral modification, the increase in efficacy due to the formation of volatile tin sodium halides is not recognized and the efficacies actually disclosed will have been achieved by the use of high operating powers with consequent "over-running" of the lamps.

It is the object of the present invention to provide a halide discharge lamp of outstandingly high efficacy at normal operating powers, while having an improved colour appearance.

We have now found that high-pressure discharge lamps of higher efficacy, as demonstrated by the Examples hereinafter, can be obtained with the vapours of one or more tin halides and one or more sodium halides, present together with mercury and a rare gas, which combine to form highly volatile complex compounds containing both sodium and tin and the halogen or halogens and produce higher concentrations of sodium halide and sodium in the arc than can be achieved by evaporation of sodium halide alone.

With the present invention luminous efficacies exceeding 90lmW$^{-1}$ have been obtained at input powers not exceeding 300W. In the prior art, efficacies exceeding 70lmW$^{-1}$ have generally only been attained in lamps containing sodium halides and tin halides when operated at 400W or more. In many applications, lower power lamps are desirable, and are provided by the present invention.

The lamps according to this invention may thus be defined as high pressure electrical discharge lamps comprising a sealed light-transmitting envelope and arc electrodes and containing a fill comprising mercury, a rare gas and, at least in operation, a volatile complex halide compound of tin and sodium. The higher efficacy referred to, which can be achieved without increasing the operating power of the lamp above the conventional level for the lamp structure and dimensions concerned, is only notable when the mercury density in the fill exceeds 50 $\mu$mol cm$^{-3}$ and is preferably in the range 85 to 150 $\mu$mol cm$^{-3}$. Below 50 $\mu$mol/cc mercury density, relatively low efficacies are achieved, as shown by Examples 3 and 4 below, unless the lamp is over-run at higher power.

The preferred lamps employ as halogen either chlorine or iodine, or bromine and iodine, or bromine alone. The envelope or arc tube may be contained within an outer light-transmitting jacket, in known manner.

Where the complex halide compound can be prepared and handled as such, the compound itself can be introduced into the lamp envelope during manufacture of the lamp. Alternatively or additionally, however, the elements concerned may be introduced into the envelope in any convenient form. The invention thus extends to any discharge lamp containing a fill of mercury, rare gas, halogen, tin and sodium in appropriate proportions for the formulation of a substantial proportion of one or more volatile tin sodium halides. Such fills are exemplified in the practical embodiments described below.

The high-pressure discharge lamps of this invention overcome some of the colour appearance problems of the tin halide discharges whilst enhancing the efficacy of the lamps. It has been found that the properties of these discharges differ from those in tin halides or sodium halides, and that they have desirable properties not exhibited either by tin halide discharges with or without mercury or by sodium halide discharges alone. At least some of these properties result from the formation of complex compounds of the tin halides and alkali metal halides. One such compound is $NaSnCl_3$, molecules of which can be present in both liquid and vapour phases. Other complex compounds between tin halides and alkali metal halides also exist. One property of these complex compounds that is exploited in the present invention is their high volatility. For example, according to vapour pressure data, there are approximately 2 $\times$ 10$^{14}$ cm$^{-3}$ NaCl molecules in equilibrium with sodium chloride at 953° K. (680° C.). In equilibrium above liquid $NaSnCl_3$ at the same temperature there are approximately 10$^{18}$ cm$^{-3}$ of $NaSnCl_3$ molecules. When $NaSnCl_3$ dissociates in the discharge it produces NaCl molecules. Thus there are up to 10$^4$ times more NaCl molecules available in the vapour phase and the partial pressure of sodium atoms and sodium-containing molecules is greatly enhanced by this means. To obtain a concentration of 10$^{18}$ cm$^{-3}$ of NaCl molecules by volatilizing NaCl would require a liquid pool temperature in the region of 1000–1100° C., thus putting a severe restriction on the choice of arc tube materials. Another desirable property of the lamps of this invention, which is probably associated with the formation of complex compounds, is that in some cases the colour appearance of the discharge is comparatively insensitive to the molar ratio of sodium halide to tin halide.

Preferred practical embodiments of the invention have a discharge tube constructed from transparent fused silica, or polycrystalline or single crystal alumina. The power loading at the wall is in the range 10-100Wcm$^{-2}$ and the temperature of the coolest point in the lamp is in excess of 500° C. The discharge tube is dosed with the following constituents, which may be introduced by using an appropriate selection from rare gases (Ne, Ar, Kr, Xe), tin halides, mercury halides, sodium halides, tin metal, sodium metal, mercury, complex halides of tin and sodium, elemental halogens or other convenient source of the elements concerned:

1. A total pressure of 5 to 100 torr (at 20° C.) of rare gas or a mixture of rare gases.
2. Tin in the range 5 to 100 μmol cm$^{-3}$, preferably 30 to 50 μmol cm$^{-3}$.
3. One or more of the sodium halides NaCl, NaBr, NaI, to give a total quantity of sodium halide in the range 1 to 250 μmol cm$^{-3}$.
4. Additional halogen atoms, which should include Cl or Br, in a total amount within the range 5 to 100 and preferably 30 to 50 μmol cm$^{-3}$, with
   (a) an atomic ratio of Cl/I in the range 0.5 to 5 or
   (b) an atomic ratio of Br/I in the range 0.5 to 5 or
   (c) bromine only present.
5. Mercury in the range 50 to 150, preferably 85 to 150 μmol cm$^{-3}$.

The ratio of sodium halide to tin halide (expressed in molar terms) has little effect on efficacy but does affect colour properties. To obtain satisfactory properties (3000 to 4000° K. colour temperature with good colour rendering) using lamps at the high end of the mercury range, a molar ratio of 0.6 to 3 is preferred, but at the lower end of our mercury range, a molar ratio of 0.1 to 1 is preferred.

Figure 2:
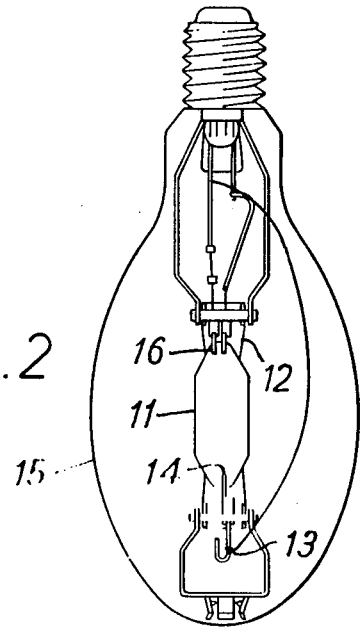

In the accompanying drawings:

FIG. 1 is a side view of one example of a discharge tube suitable for the purposes of this invention; and FIG. 2 is a side view of a further example of a form of discharge lamp also suitable for this invention.

In the lamp of FIG. 1 a silica discharge tube 11 is closed at either end by pinches 12 which make hermetic seals round the current leads 13. These current leads are connected to tungsten electrodes 14 which may incorporate electron emissive material. The discharge operates between the electrodes. The discharge tube has an internal diameter of 6 mm with the tips of the tungsten electrodes separated by 20 mm. The volume may typically be 1 cm$^3$. A discharge tube of similar construction, shown in FIG. 2, has a volume of 4.3 cm$^3$, an internal diameter of 15 mm in the centre and electrode separation 20 mm. An auxiliary electrode 16 may be included to assist in starting. The ends are shaped to make the temperature of the coolest region as high as possible. In both examples, the temperature of the ends of the discharge tube may also be increased by a coating of zirconia on the tube ends or by any other suitable means.

Either form of discharge tube can be mounted in the conventional type of hard glass bulb shown in FIG. 2, preferably with a support frame of a type known to inhibit sodium migration through the discharge tube.

The following are examples which illustrate the practice of the invention.

EXAMPLE 1

A discharge tube of the type shown in FIG. 1 was dosed with the following components, expressed as weight per cm$^3$:

$Hg_2Cl_2$: 6.2 mg
$HgI_2$: 3.1 mg
Hg: 18.2 mg
Sn: 4.9 mg
NaCl: 0.88 mg and also with:
Argon: 50 torr at room temperature.

This discharge tube therefore contained 41 μmol cm$^{-3}$ Sn, 15.1 μmol cm$^{-3}$ NaCl, other halogen atoms (Cl, I) 39.9 μmol cm$^{-3}$, in an atomic ratio Cl:I of 2:1, and mercury 124 μmol cm$^{-3}$.

This discharge lamp could be operated with the following characteristics: power 260W, efficacy 90 lmW$^{-1}$, temperature of condensed halide 700° C., chromaticity coordinates x = 0.385, y = 0.387, correlated colour temperature 3950° K., CIE general colour rendering index 76.

EXAMPLE 2

A discharge tube of the type shown in FIG. 1 was dosed with the same components as in Example 1 except that the sodium chloride weight was 2.9 mg cm$^{-3}$ (50 μmol cm$^{-3}$).

This discharge lamp could be operated with the following characteristics: power 260W, efficacy 95 lmW$^{-1}$, temperature of condensed halide 700° C., chromaticity coordinates x = 0.385, y = 0.381, correlated colour temperature 3900° K., CIE general colour rendering index 72.

These examples also illustrate that the chromaticity coordinates are very insensitive to the proportion of NaCl.

The following Examples 3 and 4 illustrate the performance of lamps containing tin and sodium halide in the fill, but having a lower mercury, tin and additional halogen density than the lamps of Examples 1 and 2 and exhibiting much lower efficacy at comparable power.

EXAMPLE 3

A discharge tube of the type shown in FIG. 2 was dosed with the following components, expressed as weight per cm$^3$:

$Hg_2Cl_2$: 0.76 mg
$HgI_2$: 0.72 mg
Hg: 3.03 mg
Sn: 0.59 mg
NaCl: 0.30 mg and also with:
Argon: 30 torr at room temperature.

This discharge tube therefore contained 5.0 μmol cm$^{-3}$ Sn, 5.1 μmol cm$^{-3}$ NaCl, 6.4 μmol cm$^{-3}$ other halogen atoms (Cl,I) in an atomic ratio Cl:I of 1:1, and mercury 19.9 μmol cm$^{-3}$.

This discharge lamp could be operated with the following characteristics: power 253W, efficacy 50 lmW$^{-1}$, temperature of condensed halide 590° C., chromaticity coordinates x = 0.359, y = 0.375, correlated colour temperature 4600° K. CIE general colour rendering index 56. It could also be operated at 400W when the efficacy was 69 lmW$^{-1}$, the chromaticity coordinates x = 0.359, y = 0.354, correlated colour temperature 4500° K. and CIE general colour rendering index 65.

EXAMPLE 4

A discharge tube of the type shown in FIG. 1 was dosed with components with the same weights per cm$^3$ as Example 3 except that the sodium chloride weight was 0.15 mg cm$^{-3}$ (2.6 μmol cm$^{-3}$) and the argon pressure was 50 torr at room temperature. Again, efficacy was low, being only 41 $lmW^{-1}$ at 260W.

We claim:

1. In an electrical discharge lamp comprising a sealed light-transmitting envelope having arc electrodes spaced and sealed therein, leads for said electrodes and a volatile fill in said envelope, the improvement which consists in a fill comprising in combination an amount of mercury in excess of 50 $\mu mol\ cm^{-3}$, a rare gas and, at least during operation, a volatile complex halide compound of tin and sodium.

2. The lamp of claim 1 wherein the amount of tin is 5 to 100 $\mu mol\ cm^{-3}$.

3. The lamp of claim 2 wherein the fill contains additional halogen atoms in a total quantity of 5 to 100 $\mu mol\ cm^{-3}$ and selected from chlorine and bromine in the presence of iodine at an atomic ratio of 0.5 to 5 Cl/I or Br/I or bromine in the absence of other halogen.

4. The lamp of claim 3 wherein the fill contains 1 to 250 $\mu mol\ cm^{-3}$ sodium halide.

5. The lamp of claim 5 wherein the pressure of rare gas is 5 to 100 torr at 20° C. and the quantity of mercury is in the range 50 to 150 $\mu mol\ cm^{-3}$.

6. The lamp of claim 3 wherein said atomic ratio is greater than 1.

7. The lamp of claim 6 wherein said atomic ratio is about 2:1.

8. The lamp of claim 3 wherein the total quantity of said additional halogen atoms is about 40 $\mu mol\ cm^{-3}$ or more.

9. The lamp of claim 1 wherein said envelope is of polycrystalline or single crystal alumina.

* * * * *